United States Patent [19]

Taipale et al.

[11] Patent Number: 4,586,522

[45] Date of Patent: May 6, 1986

[54] COIN HANDLING AND SORTING

[75] Inventors: Dale L. Taipale, Delafield; John H. Winkelman, Hartland; Thomas P. Adams, Oconomowoc, all of Wis.

[73] Assignee: Brandt, Inc., Watertown, Wis.

[21] Appl. No.: 596,257

[22] Filed: Apr. 3, 1984

[51] Int. Cl.[4] ..... G07D 3/06

[52] U.S. Cl. ..... 133/3 E; 133/8 R

[58] Field of Search ..... 133/3 A, 3 E, 3 H, 3 R, 133/3 B, 3 C, 3 D, 8 C, 8 R; 221/259, 260, 169

[56] References Cited

U.S. PATENT DOCUMENTS

| | | | |
|---|---|---|---|
| 574,528 | 1/1897 | Elder et al. . | |
| 2,835,260 | 5/1958 | Buchholz . | |
| 2,906,276 | 9/1959 | Blanchette et al. . | |
| 4,086,928 | 5/1978 | Ristvedt et al. . | |
| 4,098,280 | 7/1978 | Ristvedt et al. . | |
| 4,111,216 | 9/1978 | Brisebarre | 133/3 A |
| 4,148,331 | 4/1979 | Nicolaus | 133/8 R |
| 4,234,003 | 11/1980 | Ristvedt et al. . | |
| 4,275,751 | 6/1981 | Bergman | 133/8 R X |
| 4,360,034 | 11/1982 | Davila et al. . | |

FOREIGN PATENT DOCUMENTS

| | | | |
|---|---|---|---|
| 2012863 | 3/1970 | Fed. Rep. of Germany . | |
| 52-74396 | 6/1977 | Japan | 133/3 A |

*Primary Examiner*—Stanley H. Tollberg
*Attorney, Agent, or Firm*—Quarles & Brady

[57] ABSTRACT

A coin sorter has a hopper in which mixed coins are deposited. A resilient horizontal disc is disposed at the bottom of the hopper and a stationary sorting plate overlies the disc. Coins are carried by the rotating disc between the disc and plate and formed into a single file and single layer and carried to an exit at the perimeter of the sorting plate. A diverter plate engages the coins at the exit and tips them to a position in which they are upright against the peripheral edge of the rotating disc. The upright coins are carried by the edge of the disc past a series of sorting stations formed as openings in curved walls. The coins fall through an opening appropriate to their particular size and into drawers that are suspended beneath the openings on a rotatable collar.

23 Claims, 19 Drawing Figures

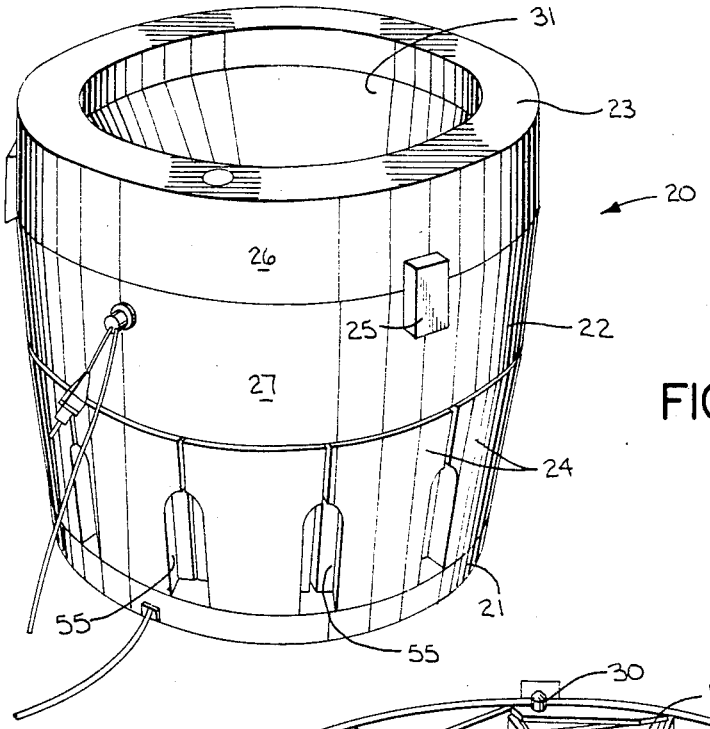
FIG. 1
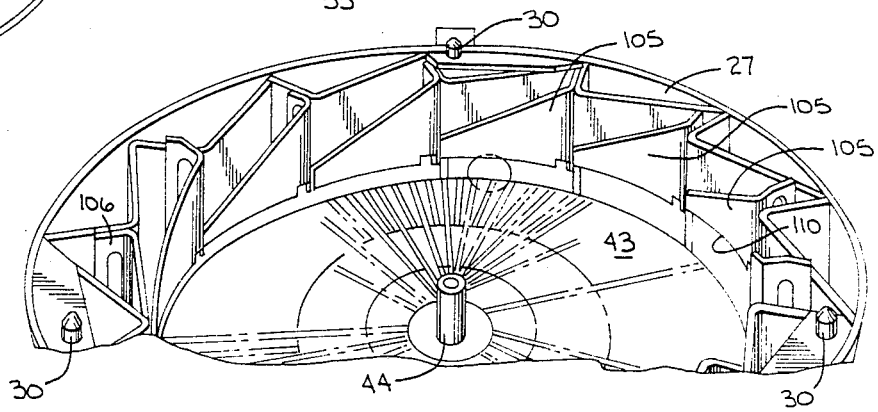
FIG. 11
FIG. 12
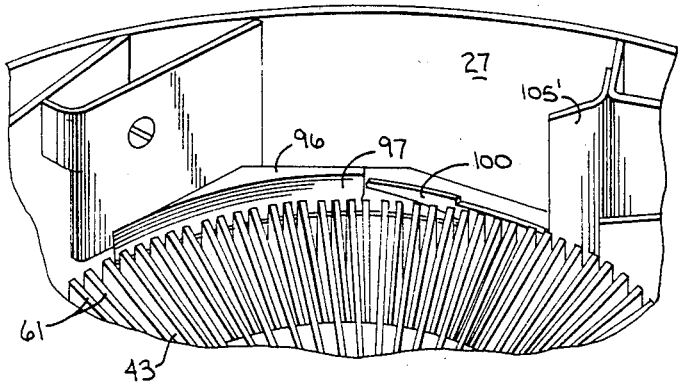

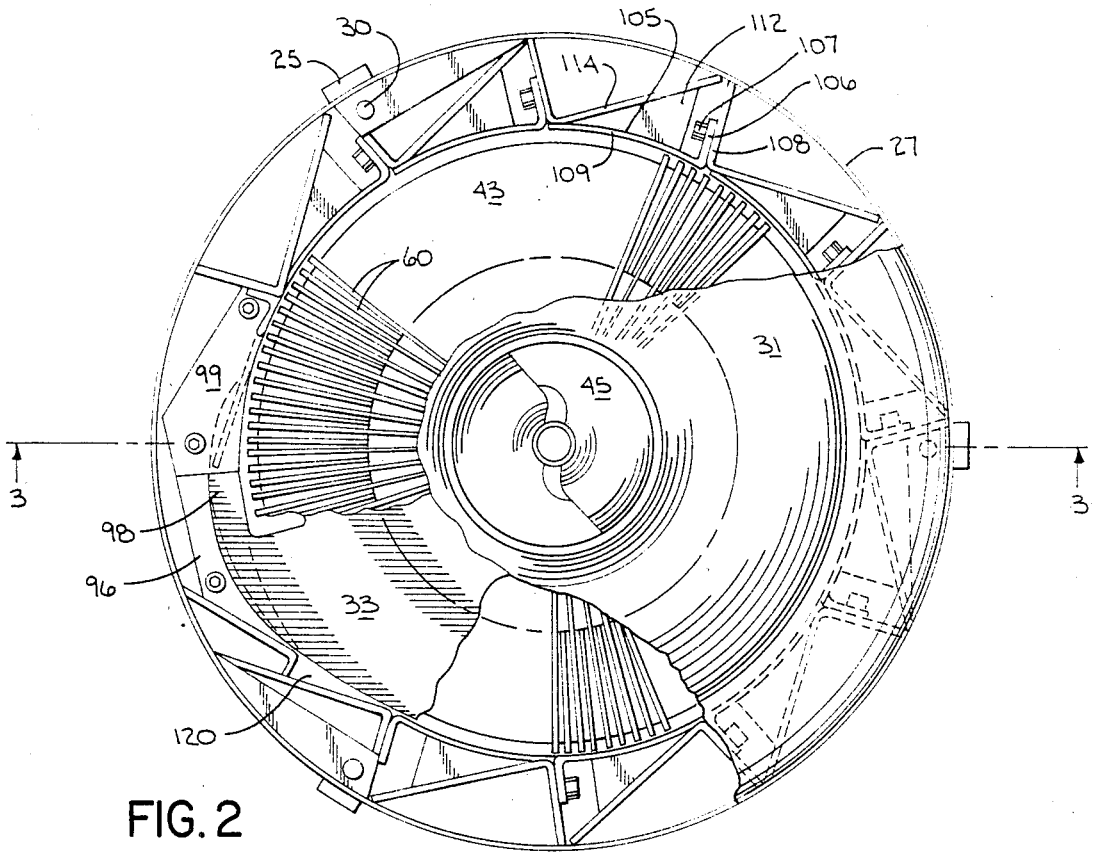
FIG. 2
FIG. 3
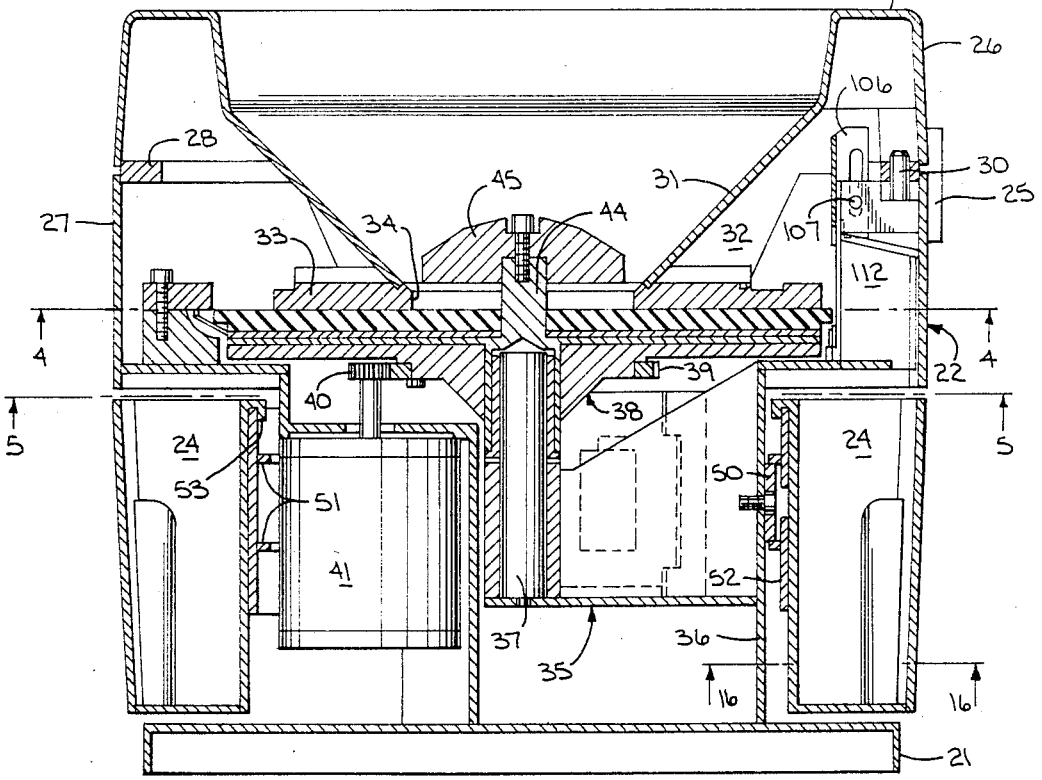

FIG. 5
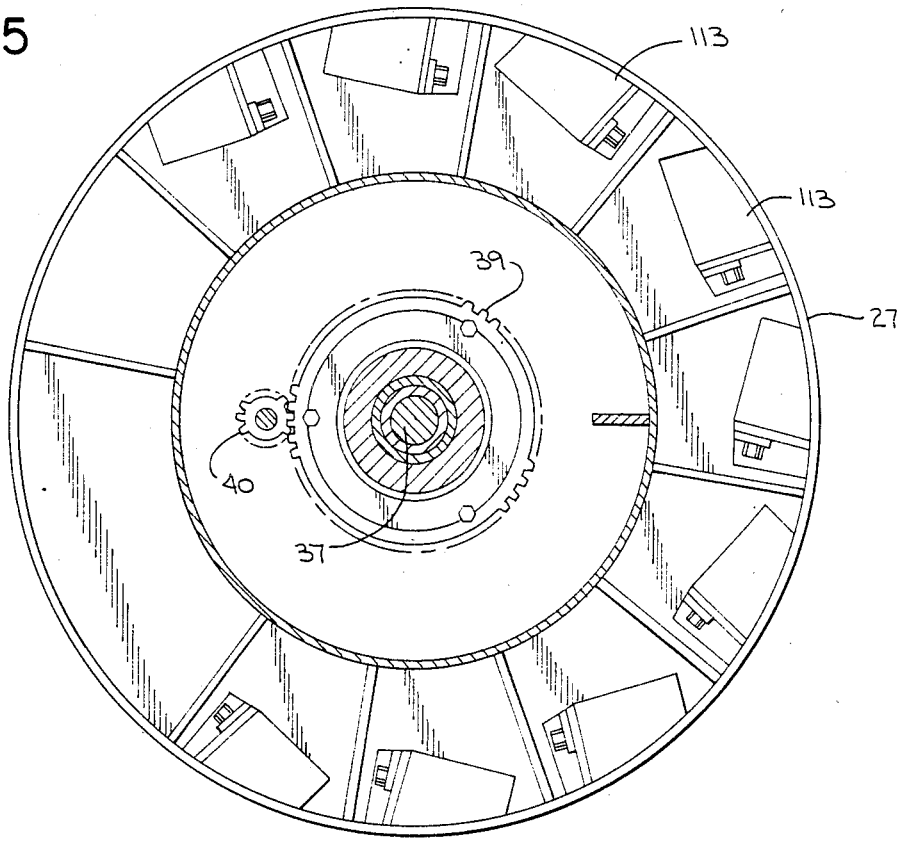
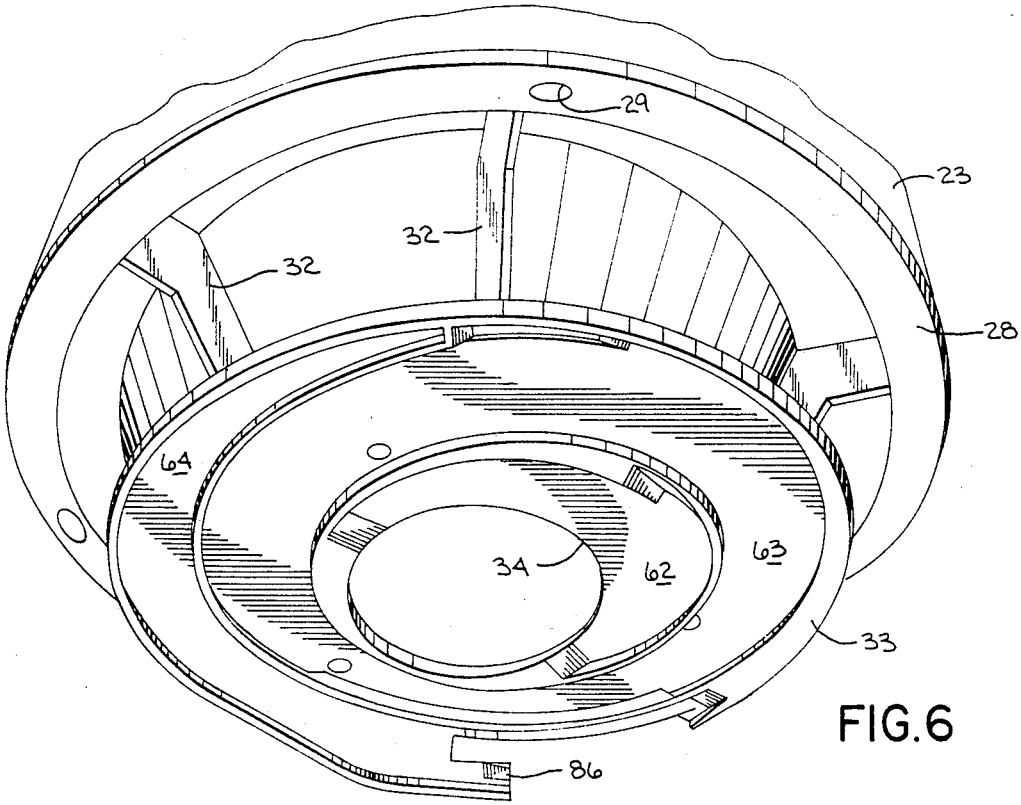
FIG. 6

FIG. 7
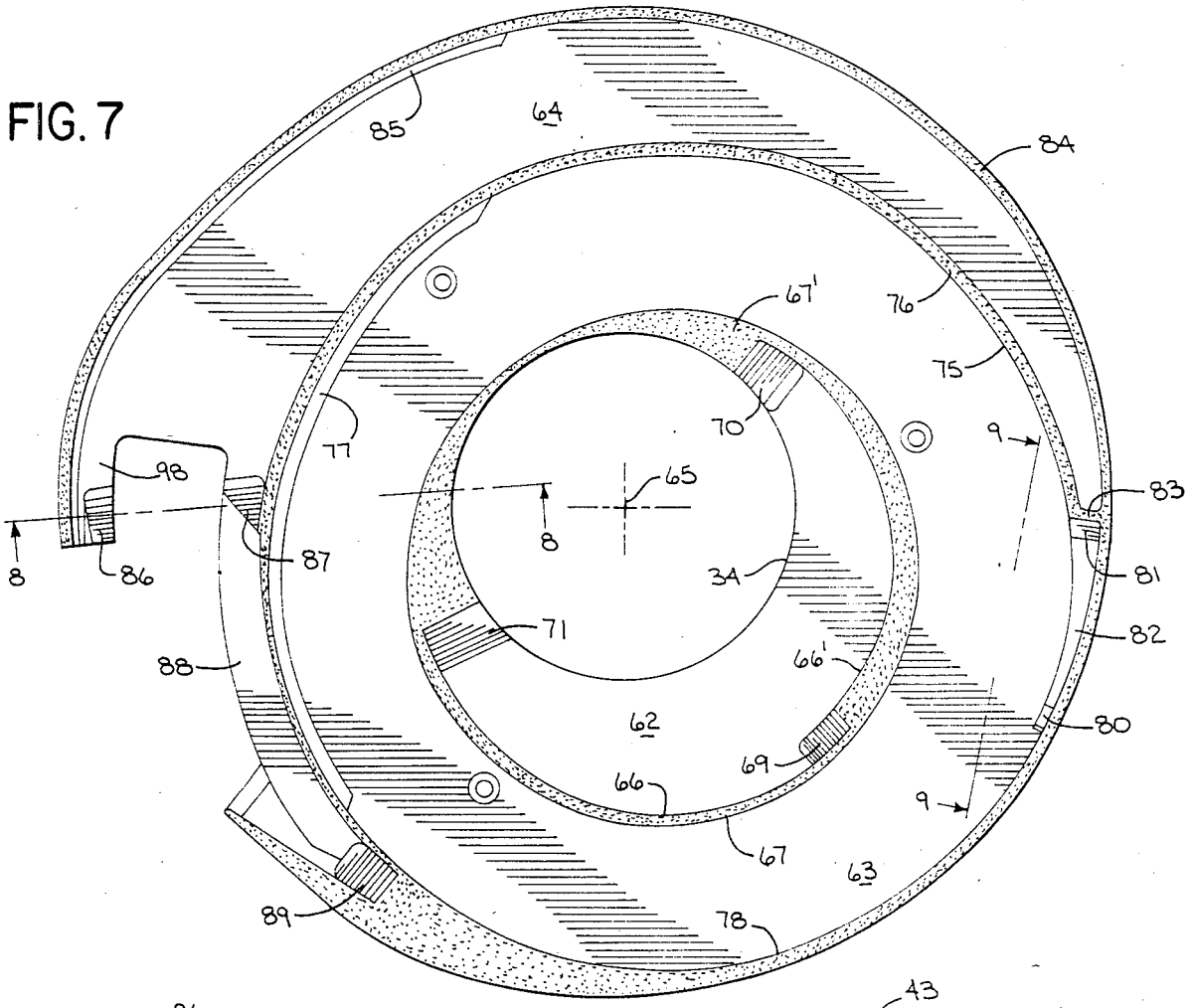
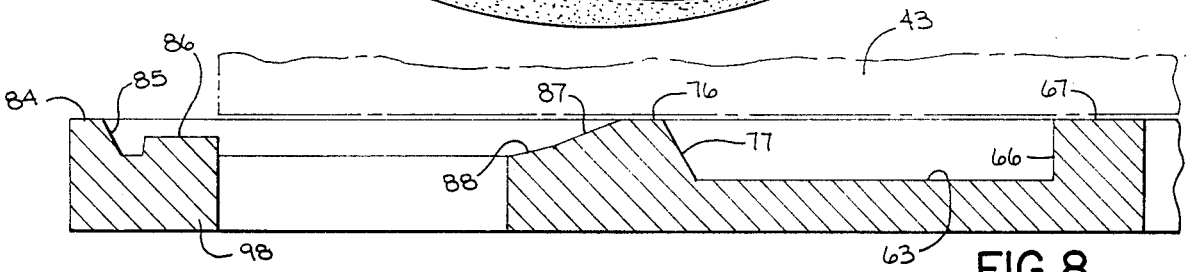
FIG. 8
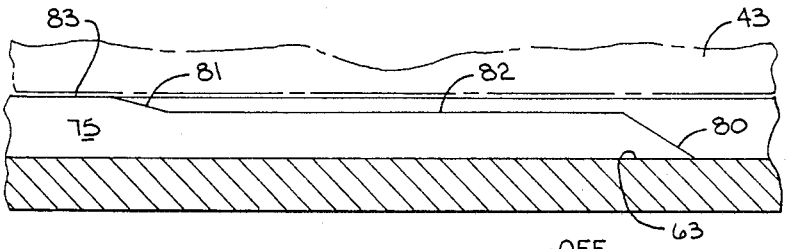
FIG. 9
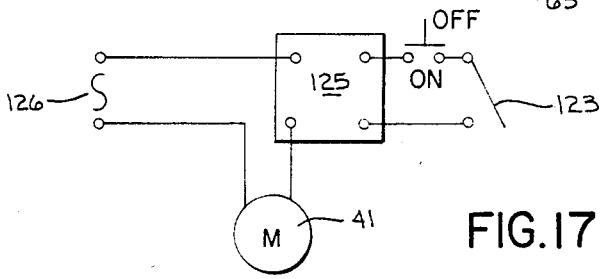
FIG. 17

FIG. 14
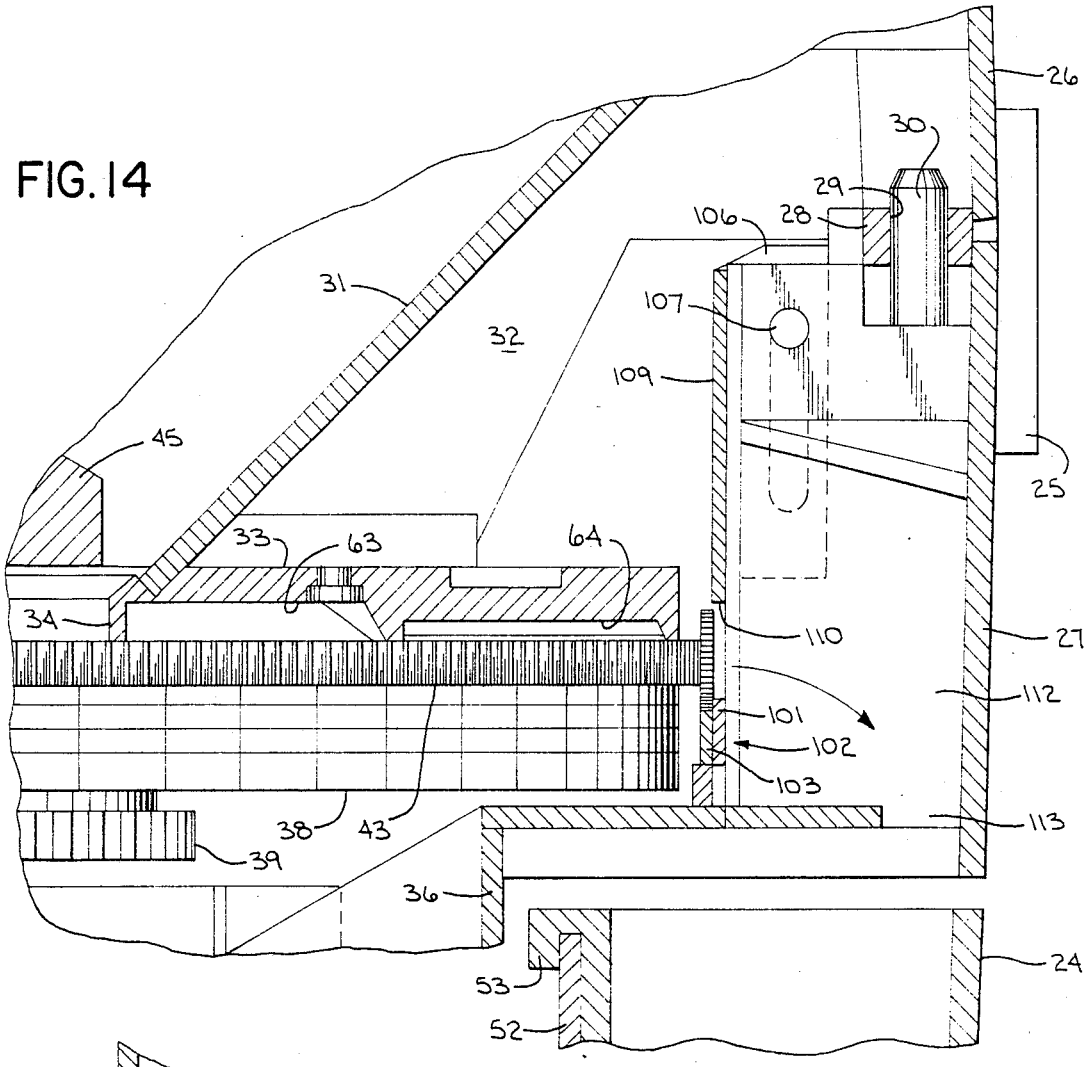
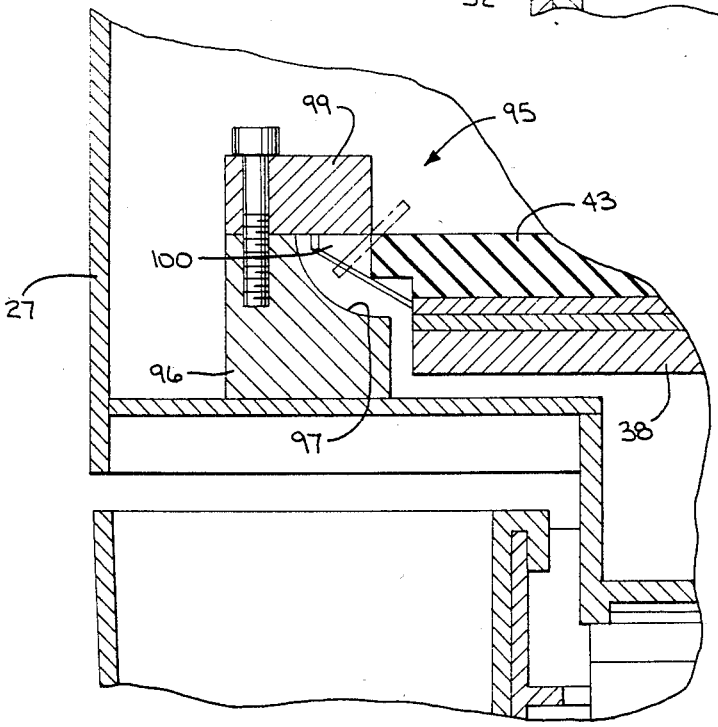
FIG. 15

COIN HANDLING AND SORTING

BACKGROUND OF THE INVENTION

This invention relates to coin handling, and more particularly to an improved method and improved mechanisms for sorting coins of mixed denominations and for arranging coins into a single file and single layer for subsequent sorting or other coin processing.

There are several basic types of mechanical coin sorting techniques which can be classified based upon their principles of operation. First is a rail sorter in which coins are rolled on edge, single file down an inclined ramp or rail. In order of size, each coin denomination is removed at a particular point on the ramp or rail. Removal may be by way of protrusions, called plows, which bump a coin of a particular size off the rail. Naturally, the larger coins must be removed before the smaller coins. An example of such a rail-type sorter is found in U.S. Pat. No. 574,528, issued Jan. 5, 1897 to Elder, et al. A second form of coin sorter is the so-called core sorter in which individual coins are carried by an inclined rotating scalloped plate to an elevated opening where the coins are discharged into tapered slots arrayed about the periphery of a rotating core shaped like a truncated cone. The coin settles to a particular level in the tapered slot which is unique for its size, and therefore its denomination, and is counted and removed from that level. An example of the core sorter is found in U.S. Pat. No. 2,835,260 issued May 20, 1958 to Buchholz. A third form is the sifter type of sorter in which the coins pass through a series of perforated plates of descending opening size until caught at a level appropriate to their size. An example of a sifter-type sorter is found in U.S. Pat. No. 4,360,034 issued Nov. 23, 1982 to Davila, et al.

Still another form of sorter employs a horizontal rotating disc and mechanisms by which the coins are carried by centrifugal force to an outer rim where the coins are formed into a single file. The coins may be removed at various points on the periphery by plows (see U.S. Pat. No. 2,906,276, issued Sept. 29, 1959 to Blanchette, et al.), or by flipping them over the rim (see U.S. Pat. No. 4,086,928, issued May 2, 1978 to Ristvedt, et al.). This latter patent utilizes a rotating disc which has an upper surface formed as a flexible mat which is compressible by the coins. Another approach using a flexible rotating disc is found in U.S. Pat. No. 4,098,280, issued July 4, 1978, and its related U.S. Pat. No. 4,234,003, issued Nov. 8, 1980, to Ristvedt, et al. In that approach, the coins are arrayed in a single file against a ledge until they encounter spaced areas for each denomination where the coins are no longer held between a sorter plate and the rotating disc and are free to be thrown from the disc by centrifugal force.

The coin sorter of the present invention also utilizes the surface of a rotating resilient disc in the process of separating and aligning the coins into a single file and single layer. However, it further utilizes the peripheral edge of the resilient disc to carry the aligned coins around to unique sorting stations for each size of coin. The process of separating and aligning the coins is also useful in other coin handling equipment such as coin packagers and automatic coin wrappers.

Although the invention is particularly suited to handling coins, it can also be used to handle or sort tokens, mixed coins and tokens, or any other disc-like objects which can be classified according to size. It should be understood that wherever reference is made hereafter to coins, it is intended to include tokens and such other objects as well.

SUMMARY OF THE INVENTION

In its broadest aspect, the invention involves the sorting of coins by first depositing the coins on the surface of a rotating disc which, in conjunction which an overlying plate, separates the mix of coins into a single layer and into a single file and carries the coins to an exit point adjacent the periphery of the disc. At the exit point, the coins are tipped and then engaged by the peripheral edge of the rotating disc and carried past sorting stations arrayed about the perimeter of the disc. Each denomination of coins is removed at its unique sorting station.

More particularly, the invention resides in a method of sorting coins from a mixture of coins of different denominations which includes the steps of depositing coins on the surface of a rotating disc, separating the coin mixture into a single layer and a single file of coins while moving the coins toward an exit position, tipping the coins at the exit, carrying the single file of coins along the peripheral edge of the rotating disc, and sorting the coins by size as they are carried along the peripheral edge. The method may also include the additional step of counting each coin of each denomination just prior to time that that particular denomination is sorted away from the edge of the disc.

In the preferred embodiment of the invention, the sorting of coins is carried out in ascending order of the size of the diameters of the coins.

The invention further particularly resides in a coin sorter for mixed denominations of coins which comprises a rotating disc having a generally planar resilient surface and a resilient peripheral edge, a stationary plate spaced from the surface of said disc with the plate having a central opening to receive coins on the disc and a series of guide surfaces opposing the disc, the guide surfaces separating and aligning the coins into a single file and single layer and directing the file of coins to an exit position at the periphery of the plate as the coins are moved by the disc, sorting stations disposed about the perimeter of the disc, one for each denomination of coins to be sorted, and a diverter for directing coins leaving the exit position to the peripheral edge of the disc where the coins are carried by the disc past the sorting stations.

Further in accordance with the invention, such coin sorter has a curved track disposed about a major portion of the perimeter of the disc below the planar surface thereof, and the diverter tips the coins which leave the exit position so that their edges ride on the track while being engaged by the peripheral edge of the disc and carried thereby along the track past the sorting stations.

Still further in accordance with the invention, the sorting stations are defined by a series of openings of increasing size with each opening being related to the diameter of a denomination to be sorted, and each sorting station includes a chute with an open bottom leading to a removable drawer. The plurality of drawers are disposed about the perimeter of the rotating disc and are mounted on a rotatable carrier so that all drawers are accessible from a single operator position.

Still further in accordance with the invention, there is provided a coin aligning mechanism for coins of mixed sizes of which the thickness of the thickest coin is a multiple of the thickness of the thinnest coin. The coin aligning mechanism includes a rotating disc having a resilient surface, and a stationary plate with a central opening so that coins may be placed on the disc, the plate having a series of guide surfaces opposing the surface of the disc and including a pair of ramps spaced from each other in the direction of rotation of the disc along the plate and which direct coins from a recessed area, which is spaced from the disc surface a distance greater than the thickness of the thickest coin, to an intermediate level, which is spaced from the disc surface a distance greater than the thickness of the thinnest coin but less than twice such thickness, and then to a pinch surface which is spaced from the disc surface a distance less than the thickness of the thinnest coin.

Still further in accordance with the invention, there is provided a mechanism for aligning a mixture of coins of different sizes including a rotating disc having a resilient surface, a stationary plate having a central opening so that coins may be placed on the disc, and having a series of guide surfaces opposing the disc and which separate and align the coins into a single file and single layer and direct the file of coins to a single exit position at the periphery of the plate. The guide surfaces include three recessed areas each eccentric of the axis of rotation of the disc and each spaced from the disc surface a distance greater than the thickness of the thickest coins, the recessed areas being separated from each other by walls which extend towards the disc surface and are spaced therefrom a distance less than the thickness of the thinnest coins. One of the recessed areas is adjacent the central opening and another terminates in the exit position. Ramps lead from the outer perimeter of each recessed area to a respective wall so that a single layer of coins will be moved from a recessed area to between a wall and the disc surface and then beyond the wall to the next recess area.

The invention also resides in a resilient disc for separating and aligning coins which is formed of a relatively incompressible elastomer and has a generally planar operating surface provided at the tops of a series of protrusions which are deformable to provide the necessary compressibility and resiliency. The peripheral edge of the disc may also be provided with protrusions which similarly provide a resilient and compressible edge structure.

It is a principal object of the present invention to provide a coin sorter which can handle a large number of different denominations of coins and a wide variety of coin thicknesses, and is thereby capable of sorting the coins of most countries of the World.

It is also an object of the present invention to provide a coin sorting mechanism which is compact and capable of operation from a single operator position.

It is a further object of the invention to provide a coin sorter which uses a rotating disc which can operate at relatively low rotational speed.

It is yet another object of the invention to provide an improved mechanism for separating and aligning coins of mixed sizes into a single layer and single file by use of a rotating flexible surface disc operating against a hard plate, and in which the forces required to overcome the friction between coins and between the rotating disc and plate are kept to a minimum.

The foregoing and other objects and advantages of the invention will appear in the following detailed description of the preferred embodiments. In the description reference is made to the accompanying drawings which form a part hereof.

BRIEF DESCRIPTION OF THE DRAWINGS

FIG. 1 is a view in perspective of a coin sorter in accordance with the present invention;

FIG. 2 is a top plan view of the coin sorter of FIG. 1 with portions broken away for purpose of illustration;

FIG. 3 is a view in vertical section of the coin sorter taken in the plane of the line 3—3 of FIG. 2;

FIG. 5 is a view looking upwardly through the coin sorter and taken in the plane of the line 5—5 of FIG. 3;

FIG. 6 is a view in perspective taken from below of the removable upper section including the aligning plate;

FIG. 7 is an enlarged plan view of the aligning plate;

FIG. 8 is a view in section of a portion of the aligning plate and taken in the plane of the line 8—8 of FIG. 7;

FIG. 9 is a view in section of a portion of the aligning plate and taken in the plane of the line 9—9 of FIG. 7;

FIG. 11 is a partial view in perspective of the sorting stations arranged about the perimeter of the flexible rotating disc, with the upper section of the sorter removed;

FIG. 12 is an enlarged view in perspective of the exit position with the upper section of the sorter also removed;

FIG. 14 is an enlarged view in vertical section through a sorting station of the coin sorter;

FIG. 15 is an enlarged view in vertical section through the exit position and diverter;

FIG. 17 is a schematic view of a portion of the electrical power circuit for the sorter;

DETAILED DESCRIPTION OF THE PREFERRED EMBODIMENTS

Figure 4:
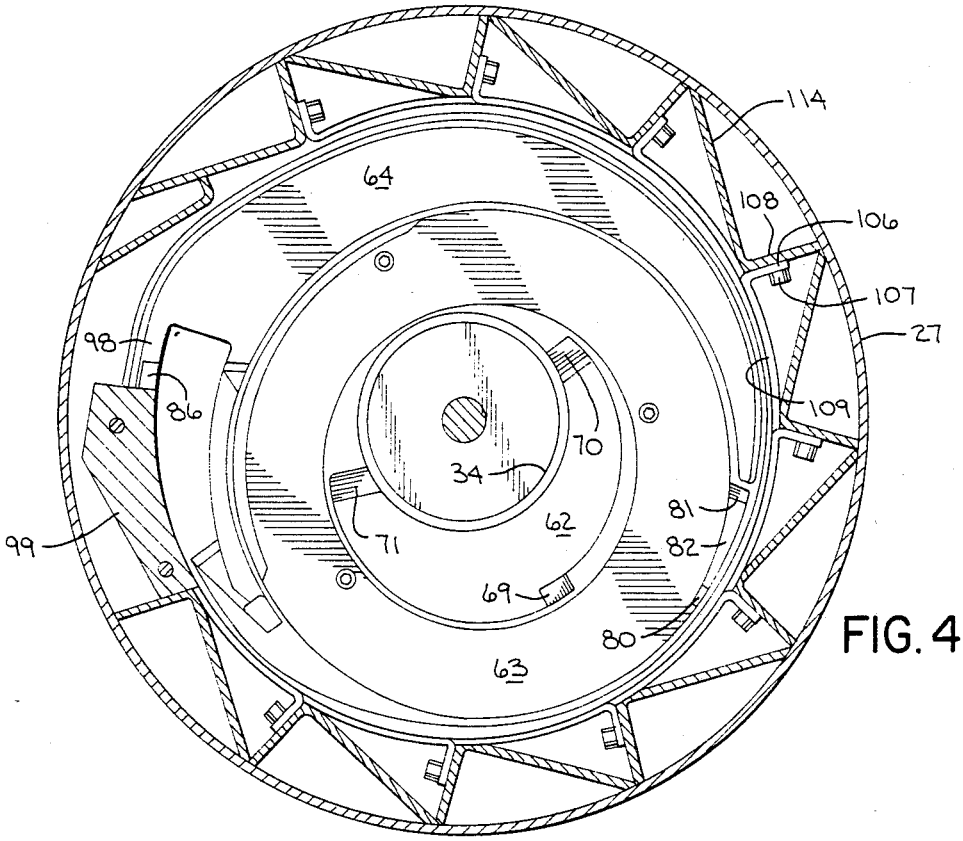
FIG. 4 is a view looking upwardly at the separating and aligning plate and taken in the plane of the line 4—4 of FIG. 3.

Referring to FIGS. 1 and 3, the coin sorter 20 includes a base 21, a center section 22, a removable upper section 23, and a plurality of drawers 24 which are disposed beneath the center section 22 and above the base 21. The upper section 23 is removably fastened to the center section 22 by three latches 25 which connect a skirt 26 of the upper section 23 to the outer envelope 27 of the center section 22. The upper section includes a circular flange 28 secured to the inner periphery of the skirt 26 and which contains three mounting holes 29 which receive pins 30 projecting upwardly from the top of the center section 22.

The upper section 23 includes a central inwardly sloping hopper 31 supported by a plurality of spaced reinforcing ribs 32. A separating and aligning plate 33 is mounted by screws to the bottom of the hopper 31 and reinforcing ribs 32. The plate 33 has a central opening 34 which is the termination of the hopper 31. The plate 33 has a series of guide surfaces on its underside which, as will be explained in detail hereafter, will direct coins to be separated into a single layer and into a single file.

A superstructure 35 which includes a hollow generally cylindrical column 36 rises from the base 21 and supports the center section 22. The superstructure mounts a vertical shaft 37 on which a rotatable disc assembly 38 is journaled. The rotating disc assembly includes a ring gear 39 which meshes with a pinion 40 on the output shaft of an electric motor 41 mounted in a recess in the column 36 of the superstructure. The disc assembly 38 includes a flexible disc 43 on its top and which is disposed opposing the underside, or working surface, of the aligning plate 33. A stub shaft 44 extends through the center of the flexible disc 43 and removably mounts an agitator 45 which occupies a principal portion of the central opening 34 in the plate 33. The agitator 45 will rotate with the disc assembly 37 and prevent coins from bridging over the central opening 34 in the plate 33 while allowing a managable flow of coins beneath the agitator 45 and into the central opening 34.

The ring gear 39 and the pinion 40 are each removably mounted on the disc assembly 38 and motor shaft, respectively, so that the gear and pinion can be replaced when converting the sorter to operate on the current frequency of various countries while maintaining a constant speed of rotation for the disc 43. Access to the gear 39 and pinion 40 is easily obtained by removing the upper section 23 which exposes the disc assembly 38 and then lifting the disc assembly 38 off of the vertical shaft 36. Only gravity holds the disc assembly 38 in place on the stationary shaft 36.

A plurality of wheels 50 are rotatably mounted about the periphery of the column 36. Vertically spaced rails 51 are disposed along the inner periphery of a collar 52 and define a track which engages the wheels 50 so that the collar 52 can be rotated around the superstructure 35 on the wheels 50. The drawers 24 are formed with a depending lip 53 on their rear surface which can be hooked over the top of the collar 52 to support each drawer 24. Spaced ribs 54 project radially outwardly of the collar 52 to define the locations for the drawers 24. The drawers 24 are provided with a pair of spaced finger recesses or pockets 55 in their front corners so that a drawer 24 may be easily gripped by an operator and lifted off of the collar 52 for removal. As shown in FIGS. 1 and 3 in particular, the drawers 24 fit within the circumference of the envelope 27 defining the outmost surface of the central section 22. The drawers are thereby tucked away.

Figure 10:
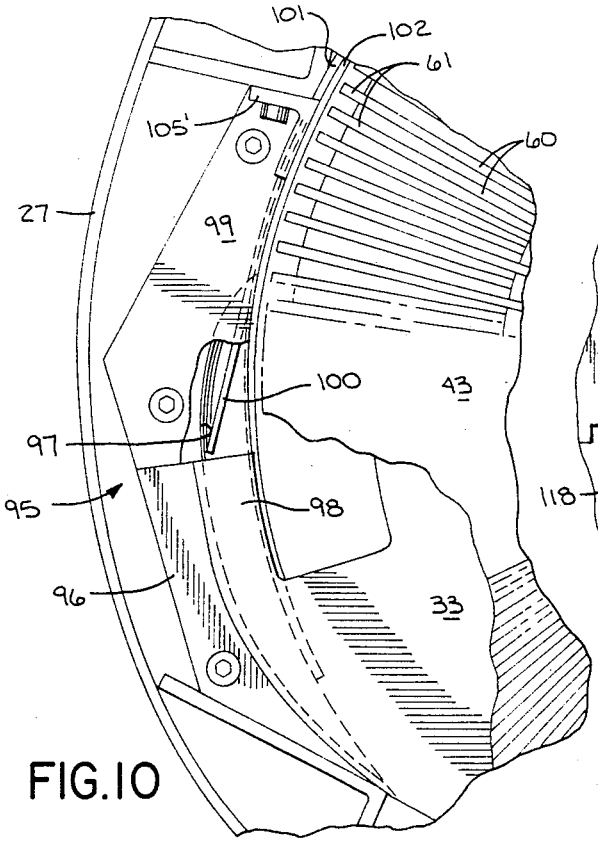
FIG. 10 is an enlarged partial view of the exit position of the aligning plate and the diverter structure of the sorter, with portions broken away for clarity.

Referring to FIGS. 2, 10 and 12, the flexible disc 43 is composed of a rubber or other elastomer which is reinforced and has its top, generally planar surface, formed with a series of spaced ribs 60 radiating outwardly from the center of rotation of the disc 43. The ribs 60 extend beyond the normal edge of the disc 43 to terminate in flexible fingers 61 at the absolute periphery of the disc 43. The fingers 61 define a flexible peripheral edge of the rotating disc 43. The ribbed upper surface of the flexible disc 43 will engage coins which are against its surface and force them over the guide surfaces on the aligning plate 33. The ribbed surface is also compressible so that coins can be pinched between the plate 33 and disc 43.

Referring now to FIGS. 4, 6 and 7, the plate 33 has a series of three arcuate, recessed areas 62, 63 and 64 which are generally concentric and which are eccentric of the center of rotation of the disc 43. (The center of rotation is illustrated in FIG. 7 by the reference numeral 65.) Each of the recessed areas 62, 63 and 64 has a flat surface which is spaced from the opposing upper surface of the flexible disc 43 a distance which is at least greater than the thickness of the thickest coin to be handled. In fact, the middle recessed area 63 is spaced a distance which is substantially greater than the thickest coin to to be handled.

The entry recessed area 62 is adjacent the central opening 34 in the plate 33. The entry recessed area 62 is bounded by a continuous, arcuate wall 66 which is disposed eccentric of the axis of rotation 65. The wall 66 has a bottom surface 67 which lies in a plane which is nearly touching the upper surface of the ribs 60 of the flexible disc 43. The spacing between the wall surface 67 and the opposing surface of the disc 43 must not exceed the thickness of the thinnest coin to be handled so that all sizes of coins can be pinched between the wall 66 and the disc 43. The wall 66 has a widened portion 66' spaced at a maximum distance from the center of rotation 65. A ramp 69 extends from the entry recessed area 62 along the inner perimeter of the wall 66 to the widened portion 66'. A single layer of coins can be forced by the rotating disc 43 along the ramp 69 to be pinched between the surface 67 and the disc 43 and then carried by the disc at a constant radius from the center of rotation 65. Since the wall 66 is eccentric to the center of rotation, the pinched coins will be carried beyond the surface 67 and into the middle recessed area 63. The ramp 69 is of a width in the radial direction which is wide enough to accommodate only a single file of coins so that only a single file of coins should be moved from the entry recessed area 62 to the middle recessed area 63.

Coins which are not forced along the ramp 69 and beyond the wall 66 are recycled back into the recessed area 62 by being forced up an additional ramp 70 to a surface 67' of the wall 66 and held there by being pinched until they are carried around to a re-entry ramp 71 which returns the coins into the entry recessed area 62.

Coins moving in the entry recessed area 62 are not all moving at the speed of the rotating disc 43. Most coins actually slide relative to the disc surface, particularly since there may be multiple layers of the thinnest coins in the entry recessed area 62 although only one layer of the thickest coins. Because the coins are sliding in this area, any coin which travels along the ramp 69 to the wall surface 67 and is thereby pressed and pinched into the resilient disc 43 will immediately attain the speed of the disc. That coin will accelerate while others will not. This provides spacing between stacked or overlapping coins, a shearing of the coin layers, and a uniform flow of coins from the entry recessed area 62. Thus, there is an initial separation of the coins into a single layer and the flow of a single file of spaced coins into the middle recessed area 63.

The middle recessed area 63 is defined by the first wall 66 along its inner periphery and by a generally circular wall 75 on its outer periphery. The wall 75 also has a surface 76 which extends close to the surface of the flexible disc 43 and preferably lies in the same plane as the surface 67 of the first wall 66. The coins which have been fed in a single layer and single file and with proper spacing into the middle recessed area 63 will simply rest upon the upper surface of the disc 43 as it rotates. The middle recessed area 63 has sufficient clearance between the walls 66 and 75 which border it to freely accommodate the largest diameter of coin. Coins in the middle recessed area will be carried on the surface of the disc 43 from a minimum radius to a maximum radius adjacent the outer perimeter of the plate 33. Centrifugal force will cause the coins to hug the innermost edge of the wall 75 as they are carried around so that a single file of coins should be aligned against the inner periphery of the wall 75. The essentially constant width of the middle recessed area 63 prevents funneling of the coins as they are moved from minimum to maximum radius positions, and the cross sectional area of the circulating coin mass is maintained essentially constant. A tapered wall section 77 may be provided along the inner edge of all or a portion of the wall 75 to wedge coins between the tapered wall 77 and the surface of the disc 43 to prevent bouncing of coins off the wall 75 as they are circulated.

Coins which are properly positioned against the inner periphery 78 of the wall 75 in the middle recessed area 63 will thereafter encounter two consecutive ramps 80 and 81. Ramp 80 leads from the surface of the middle recessed area 63 to an intermediate level surface 82 which is spaced from the disc 43 a distance greater than the thickness of the thinnest coin but less than twice the thickness of the thinnest coin. Thus, as the coins travel along the inner periphery 78 of the wall 75, they will first travel along the ramp 80 and encounter the intermediate surface 82. This surface will not pinch the thinnest coin, but will pinch a double layer or overlapped layers of the thinnest coin, or overlapped layers of the thinnest coin and other coins if they should happen to be present. The coin which is against the surface of the disc 43 will accelerate and be stripped from an overlapped or double layer of coins. Thin coins tend to overtake thicker coins as they rotate through the middle recessed area 63 and a second coin can get under a first coin. By stripping a single layer of coins beyond the first ramp 80, the leading coins are accelerated and separated.

Every coin, regardless of thickness, will travel along the second ramp 81 and be pinched at the pinch surface 83 which is in the same plane as the surface 76 of the wall 75. The pinch surface 83 also marks a junction point with an outer arcuate wall 84 which defines the outer boundary of the exit recessed area 64 whose inner boundary is defined by the wall 75. The length of the intermediate surface 82 provides a dwell period so that the initial pinch of coins following the ramp 80 will be maintained until a sufficient portion of the coin (more than half the diameter of the smallest coin) is under the pinch surface 82. For the same reason, the intermediate surface widens in the direction of rotation of the disc and the width of the second ramp 81 is greater than the width of the first ramp 80. In this way, when a small coin is completely pressed into the resilient disc 43 after having moved up the ramp 81, the coin will not tip due to differential pressures. Tipping could allow a second coin to become lodged beneath the tipped coin and the overlapped or doubled coins could pass over a ramp as one. The ramps 80 and 81 are both narrow enough to insure that only a single file of coins can travel over these ramps. The double ramps 80 and 81 together with the intermediate surface 82 which widens in the direction of movement of coins and which is spaced from the disc surface more than the thickness of the thinnest coin but less than twice such thickness allows the successful handling of a wide variety of coin sizes in terms of both thickness and diameter. The relative sizes of the largest and smallest diameter coins are illustrated in phantom lines in FIG. 7.

As indicated above, it has been determined that multiple layers of coins will shear their layers as they pass through a pinch between a resilient pad 43 and the plate 32. Furthermore, on the average, a gap is created between coins due to the retardation and subsequent speed up of coin flow at a pinch. The pinching action at the ramp 69 and at the ramps 80 and 81 should perform in this manner to eliminate all overlapping coins. However, it is still possible at the ramp 81 to have some layering or overlapping of coins. Therefore, the coins are pinched for a time and carried at an essentially constant radius beyond the surface 83 before they are released completely into the exit recessed area 64 to eliminate any residual coin overlapping. This final pinching is between the disc 43 and the surface 76 of the wall 75 which merges with the surface 83. The coins are released from this last pinch by the gradual widening of the distance between the inner wall 75 and the outer wall 84. As the distance increases between the walls 75 and 84, the smallest diameter coin will first be released completely and coins will be released in ascending order of their diameter. Finally, the coins are totally released from the last pinch and are free in the exit recessed area 64. Centrifugal force will cause the single layer and single file of coins to hug the inner edge of the outer wall 84. That inner edge may also be provided with a tapered portion 85 to prevent coins from bouncing along the walls 84.

Coins which are properly positioned single file against the inner edge of the outer wall 84 will encounter an exit ramp 86 at an exit position of the plate 33. Coins which are not properly positioned against the outer wall 84 will be carried along a ramp 87 to an inclined area 88 of the plate where they are wedged against the upper surface of the disc 43 and then carried to a re-entry ramp 89 and pinched between a widened portion 76' of the surface 76 of the wall 75 until they are carried on a constant radius back into the middle recessed area 63.

For purpose of illustration in FIG. 7, all of the surfaces 67, 76 and 83 of the walls 65, 75 and 84 which lie in the common plane close to the surface of the disc 43 are shown stippled.

As an example of the distances between the surfaces of the plate 33 and the disc 43, it will be assumed that the thickest coin to be handled is 0.135" thick and the thinnest coin is 0.040" thick. The entry and exit recessed areas 62 and 64 would be spaced at least 0.140" from the surface of the disc 43 and the middle recessed area would be about 0.250" from the surface of the disc 43. The intermediate surface 82 would be spaced 0.60" from the surface of the disc 43. This example shows the versatility of the process of separating and aligning coins which is a part of the present invention. Prior approaches such as that of the Ristvedt, et al. U.S. Pat. No. 4,098,280 could not function on a range of coin thicknesses in which the thinnest coin is less than half the thickness of the thickest coin. The present invention similarly handles a greater range of coin diameters than previous approaches. This versatility makes the coin handling process of the present invention suitable for all round coins of the World's coinage systems.

The mechanism of the present invention for separating and aligning coins is also useful in other coin handling equipment, such as coin packagers, in which a single layer and single file of coins is needed for further processing. The separating and aligning mechanism is usable for handling identical coins or disc-like objects as well as mixed batches.

Coins at the exit ramp 86 will be positioned partially beyond the periphery of the resilient disc 43. As each coin travels over the exit ramp 86, it will be forced down into the fingers 61 at the periphery of the disc 43 and will compress the fingers (see FIG. 12) A coin at the exit ramp 86 will encounter a diverter assembly indicated generally by the reference numeral 95 which will tip the coins to change their attitude from horizontal to vertical. The diverter assembly 95 includes a tipper base 96 mounted on the superstructure 35 outboard of the disc assembly 38. The tipper base 96 has a trough 97 which is curved both along the direction of the periphery of the disc assembly 38 and in a direction transverse thereto to allow the coins to swing through the arc necessary to change their attitude. The fingerlike projection 98 at the end of the aligning plate 32 which includes the exit ramp 86 overlies a portion of the base 96 above the trough 97. A block 99 extends from the end of the finger projection 98 of the plate 32 and overlies the remaining portion of the base 96 and trough 97. Disposed in the trough 97 beneath the block 99 is a plow 100 which extends from a pointed end to become the upright ledge 101 of a track 102 which also includes a second, lower plate 103. The track 102 defined by the ledge 101 and the lower plate 103 extends circumferentially about a major portion of the perimeter of the disc assembly 38 beneath the top surface of the disc 43. As seen in FIG. 12, coins will be tipped by the diverter and ride along the inclined underside of the plow 100 until they are placed upright on edge on the plate 103 of the track 102 against the ledge 101. The coins will be moved to this position under the urging of the resilient disc 43 and particularly the finger 61 at the outer periphery thereof.

The coins are carried on edge seriatim along the track 102 past a series of sorting stations, one for each denomination of coins or token or similar object to be sorted.

Figure 13:
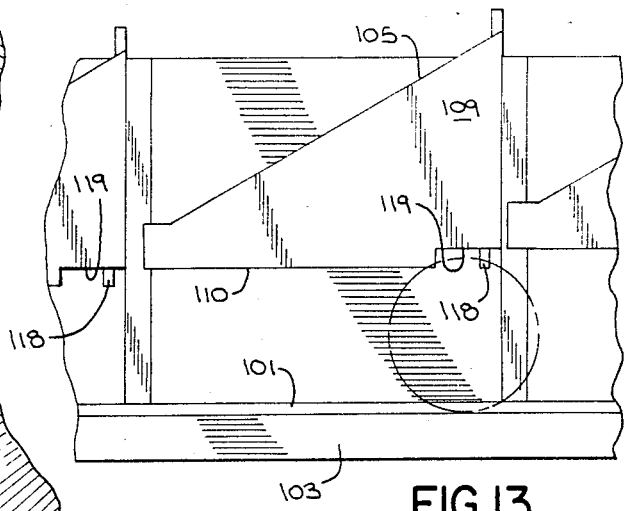
FIG. 13 is an enlarged view in elevation of a sorting station.
Figure 16:
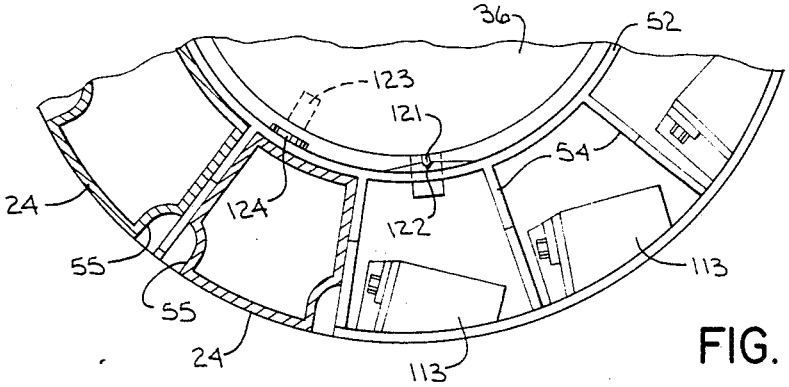
FIG. 16 is a view partially in section illustrating a detent mechanism and sensor for determining the home position of the array of drawers and taken in the plane of the line 16—16 of FIG. 3.
Figure 18:
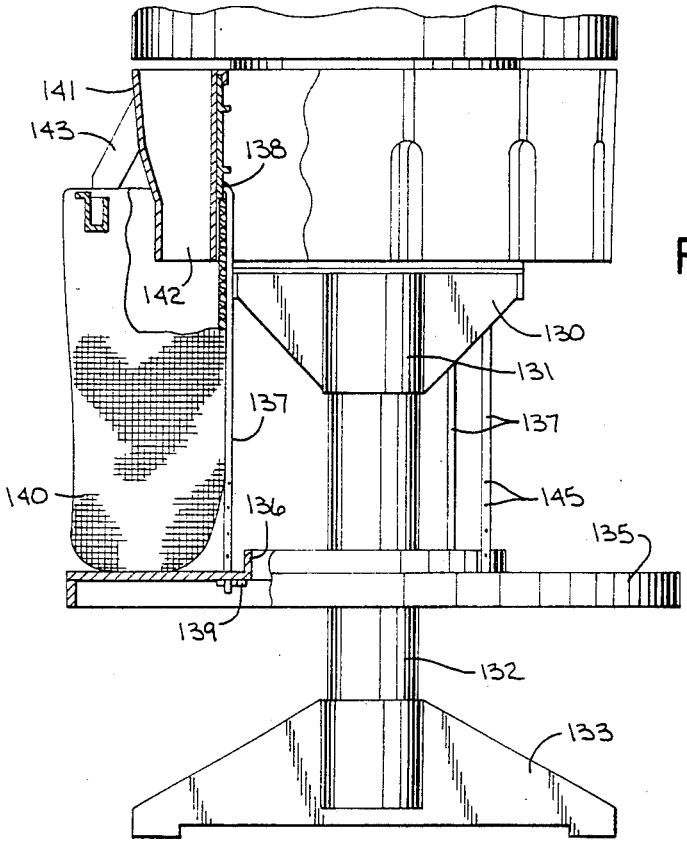
FIG. 18 is a view in elevation and partially in section of an alternative embodiment in which the coin sorter is mounted on an elevated stand and arranged for coin bags attached to coin receiving drawers.
Figure 19:
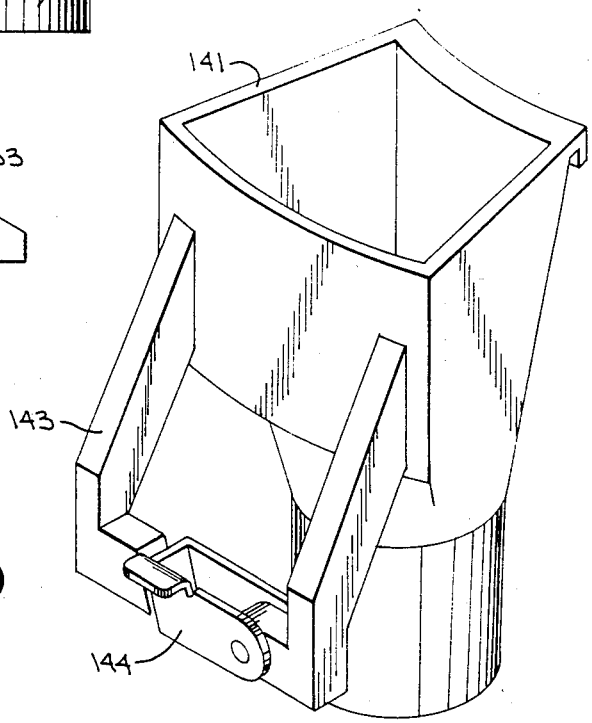
FIG. 19 is a view in perspective of a modified drawer which accepts bags.

The sorting stations are each defined by a vertically adjustable gate 105 in the form of an L-shaped bracket having its short leg 106 slotted and received on a mounting screw 107 on a support wall 108 of the center section 22. The long leg 109 of each gate 105 is curved to match the periphery of the disc assembly 38. The gate 105 has a lower edge 110 which is adjusted to a particular level above the track 102 by positioning of the gate 105 on the support wall 108. The height of the bottom edge 110 of a particular gate 105 above the track 102 is set to be just low enough so that the diameter of the coin to be sorted off at the next sorting station will ride over that gate but not the next gate (see FIG. 13). Since the sorting is done by size, it is necessary that the smallest diameter coin be removed from the track first and that coins in ascending order of size be thereafter removed. As shown in FIGS. 11 and 14, a coin of one particular diameter will slide across the gates 105 of the preceding sorting stations until it arrives at the gate 105 which has been set to allow it to pass beneath it. The gates 105 together form a series of curved walls concentric with the disc 43.

Coins passing beneath the bottom edge 110 of a gate 105 will be free to leave the track 102 through the opening created between the gate 105 and track 102 and will be moved off the track 102 by centrifugal force aided by the force of the flexible fingers 61. The coins will fall down an inclined floor 112 of a chute which terminates in an open bottom 113 disposed above the open top of a respective drawer 24. The inclined floor 112 is formed on a second support wall 114 of the center section 22. The floor 112 and support walls 107 and 113 may all be welded to, or cast integral with, the outer envelope 27 of the center section 22.

Each of the gates 105 also mounts a counting electrode 118 which is disposed in a recess 119 in the lower edge 110 of the long leg 109 near its junction with the short leg 106. The electrode 118 is thereby positioned just prior to the succeeding gate. The electrode 118 is electrically insulated from the gate 105 in which it is mounted. A coin which nears the end of a gate 105 and is of such a size that it is to be sorted off at the next gate will move off of the surface of the gate 105 at the adjacent recess 119 and for an instant will contact only the electrode 118 (see FIG. 13). At that instant, the coin will complete an electrical circuit between the electrode 118 and the track 102. The electrode 118 is at a small positive voltage, such as +5 volts, and the track 102 on which the coin is traveling is grounded. The resulting electrical impulse indicates the passage of a coin of a particular size or denomination. That impulse can be used to actuate a counter or can be used in an electronic totalizing circuit. If the coin is of such a diameter that it is not to be sorted off at the next gate, that coin will not make contact with the electrode 118 at the previous gate but instead will ride along the surface of the gate 105 above the level of the recess 119. There is a short gate 105; with an electrode, prior to the first sorting station to count the coins intended for that sorting station.

The track 102 can be advantageously mounted so that it rises slightly as it leads from the exit position of the plate 33 past the sorting stations. Also, the curved faces 109 of the gates 105 can be advantageously provided with a slight taper in the vertical direction so that the top of the faces 109 slightly overlie the track 102. Together these two modifications will assist in causing the coins to be held on the track 102 and against the gates 105 as they are moved by the fingers 61.

To summarize the operation of the sorter 20, mixed coins are deposited in the hopper 31 while the motor 41 operates to rotate the disc assembly 38. The coins will feed beneath the agitator 45 onto the surface of the disc 43. By the cooperation of the ribbed planar surface of the disc 43 and the opposing guide surfaces of the separating and aligning plate 33, the coins will be formed into a single layer and a single file of coins at the exit position of the plate. When the coins reach the exit ramp 86, they will be carried seriatim into the diverter and caused to be tipped from their horizontal position at the edge of the rotating disc 43 to a vertical position on the circumferential track 102. The fingers 61 at the peripheral edge of the rotating disc 43 will grip the upright coins and cause them to slide along the walls defined by the gates 105 until each coin encounters a gate which is positioned above the level of the coin. At that gate, the coin will be forced by the flexible fingers 61 through the opening at the gate and it will fall through a chute into the open coin drawers 24 disposed beneath the chute. The drawers are individually removable for emptying. A count of the contents of each denomination, and therefore each drawer, can be kept based upon the count pulses noted prior to each sorting station. In the particular embodiments disclosed, there are ten sorting stations, the last being an offsort station 120 in which all coins still on the track 102 will simply fall off into a chute and into a respective drawer. Thus, the offsort station 120 is used for the largest diameter coin.

Coins leaving the offsort station will be counted if they are of the size for which the previous gate has been set because they will have contacted the electrode at the previous gate. All coins will exit at the offsort station 120 but only those large diameter coins of the size for which the previous gate has been set will be counted. The same is true at every sorting station; that is, coins which are still on the track and are small enough to exit at a sorting station will exit. However, they will not be counted unless they are of the particular size (and therefore particular denomination) for which the previous gate is set to count.

The disc assembly 38 can be operated at a relatively low speed because centrifugal force plays only a minor role in the aligning of the coins and only minimal speed is needed to carry the coins around during the sorting function.

Because the attitude of the coins is changed as they are moved into the sorting section from the aligning section, the sorting stations can be close packed about the perimeter of the aligning section. This allows the use of a greater number of sorting stations and allows the handling of many more than the five or six coin denominations in use in the United States.

The drawers can be emptied by an operator standing at a single position relative to the sorter 20. This is accomplished by simply rotating the array of drawers on the rotatable collar 52. There is a home position for the array of drawers which is defined by a spring loaded pin 121 mounted on the outside of the column 36 and engaging a detent 122 formed along the inner periphery of the collar 52. To insure that the array of drawers 24 is in the home position before the sorter is operated to feed coins, a sensor switch 123 is mounted on the column 36 to confront a permanent magnet 124 mounted along the inner periphery of the collar 52 when the collar is in the home position.

Referring to FIG. 17, the sensor switch 123 is connected to a motor relay 125 which controls the connection of current from a source 126 to the electric motor 41. The motor 41 is allowed to operate only when the sensor switch 123 is closed by the presence of the permanent magnet 124.

Referring now to FIGS. 14 and 15, an alternative embodiment is disclosed in which the base 21 is replaced by a mounting bracket 130 which attaches to the underside of the superstructure 35. The mounting bracket 130 has a central tube 131 which mounts an upright cylindrical standard 132 which in turn is received in a floor stand 133. The sorter is thereby elevated above floor level. A circular support plate 135 having a central opening 136 is suspended from the collar 52 by a series of rods 137 which have a hook 138 at one end received in an opening in the collar 52 and which are drilled at their opposite ends to mount cotter pins 139. The plate 135 functions as a platform on which coin bags can rest. A bag 140 is mounted to a special bag gripping drawer 141. The bag drawer 141 has an open funnel bottom 142 and a framework 143 which mounts a spring loaded gripper 144 which can pinch bags 140 to the framework 143. The weight of the coins in the bags 140 will be supported by the plate 135. Each rod 137 is provided with a series of drilled holes 145 for the cotter pins spaced along the length of the rod so that the plate 135 can be suspended at different levels beneath the collar 52 and thereby accommodate coin bags of different sizes.

Prior attempts at separating and aligning coins by the use of a resilient rotating disc operating against a stationary, hard plate with guide surfaces have all used an elastomeric foam pad for the resilient disc surface. As the coins move against the foam pad, they are compressed and released from the surface of the pad and are forced to move radially relative to the pad. Forces are thereby created which have resulted in considerable wear and sometimes tearing of the foam pads. This wearing and tearing creates problems because excess clearances result between the surface of the rotating disc and the guide surfaces on the separating and aligning plate. As can be appreciated from the description of the process of separating and aligning in the present invention, excessive clearances or lack of control in the spacing can result in inoperability so that there is missorting of coins and coins flying out from between the disc and plate at random positions. The remedy has typically been to replace the elastomeric foam pad frequently.

The resilient disc 43 of the present invention overcomes these problems by achieving the necessary compressibility and resiliency of the disc surface without using an elastomeric foam. Instead, the disc is made from a solid elastomer material, such as rubber or polyurethane, which has very limited compressibility. The necessary compressibility and resiliency is achieved by forming the ribs 60 into the upper generally planar surface of the disc 43 and allowing those ribs 60 to be deformed laterally. Although ribs are shown, other patterns of surface protruberances may be used to achieve the same results. For example, the disc surface may consist of closely spaced upright fingers or of a series of concentric ribs. The disc 43 is preferably made by molding and thereby forming the protruberances integral with the disc. However, the protruberances could also be machined into the surface of a solid elastomer pad.

We claim:

1. A coin sorter for mixed denominations of coins, comprising:

a rotatable disc having a generally planar resilient surface and a resilient peripheral edge;

means for rotating said disc;

a stationary plate spaced from said surface of said disc, said plate having a central opening so that coins may be placed flat on said disc surface, said plate having a series of guide surfaces opposing said disc and which separate and align coins carried by said disc into a single file and single layer and direct the file of coins to an exit at the periphery of said plate;

sorting stations disposed about the perimeter of said disc, one for each denomination of coin to be sorted;

a diverter for tipping coins leaving said exit from a position flat on said disc surface to a position normal to and against the peripheral edge of said disc where the coins are carried by the edge of said disc past said sorting stations.

2. A coin sorter in accordance with claim 1, wherein:

said peripheral edge of said disc is defined by a series of radially extending, closely spaced resilient fingers.

3. A coin sorter in accordance with claim 2, wherein: said generally planar disc surface is defined by a series of closely spaced ribs which radiate from the center of rotation of said disc, and said fingers are continuations of said ribs.

4. A coin sorter in accordance with claim 1, wherein said sorting stations are defined by a series of sorting openings of increasing size with each opening related to the diameter of a denomination to be sorted.

5. A coin sorter in accordance with claim 4, wherein the size of each sorting opening is just smaller than the diameter of the denomination to be sorted at the next sorting station.

6. A coin sorter in accordance with claim 4, wherein said openings are formed in a series of curved walls arranged concentric to the peripheral edge of said disc, and said diverter directs the coins from the plane of said planar surface of said disc to the curved plane defined by said walls.

7. A coin sorter in accordance with claim 6 wherein one side of each opening is defined by a continuous circumferential track which supports the edge of each coin, and the opposite side of each opening is defined by a respective one of said walls.

8. A coin sorter for mixed denominations of coins comprising:

a rotatable disc having a generally horizontal upper resilient surface and a resilient peripheral edge;

means for rotating said disc;

a stationary plate spaced from said surface of said disc, said plate having a central opening so that coins may be placed on said disc, said plate having a series of guide surfaces opposing said disc and which separate and align the coins carried by said disc into a single file and single layer and direct the file of coins to a single exit at the periphery of said plate;

a curved track disposed about a major portion of the perimeter of said disc below the upper surface thereof;

sorting stations disposed along said track, one station for each denomination of coins to be sorted; and a diverter in the path of coins at said exit to tip coins which leave said exit into an upright position with the coin edges on said track and being engaged and carried by the peripheral edge of said disc along said track and past said sorting stations.

9. A coin sorter in accordance with claim 8 wherein said sorting stations are defined by a series of vertical sorting openings of increasing size along said track with each opening related to the diameter of a denomination to be sorted.

10. A coin sorter in accordance with claim 9 wherein the tops of said opening are formed by the bottom edges of a series of curved gates arranged concentric to the peripheral edge of said disc, and said diverter directs the coins from the plane of said disc surface to the curved plane defined by said gates.

11. A coin sorter in accordance with claim 10 wherein said gates are each mounted for vertical adjustment relative to said track to vary the vertical sorting opening.

12. A coin sorter in accordance with claim 8 wherein said diverter includes a plow extending generally tangential to the track as an extension thereof, and said plow has a descending lower surface which engages a coin projecting from the disc at the exit and directs the coins down to the track as the coin is carried past the plow.

13. A coin sorter for mixed denominations of coins, comprising:

a base;

a center section supported above the base, said center section including a circular outer envelope and a plurality of sorting stations disposed about the inner periphery of the center section;

an upper section including a coin hopper which slopes inwardly to a central opening;

a coin separating and aligning mechanism disposed beneath said hopper and including a rotating disc on which the coins are deposited and which carry a single layer and a single file of coins to the periphery of the disc; and a plurality of drawers disposed around the underside of the center section beneath the sorting stations and above the base, said drawers being removably suspended from a collar that is rotatably mounted beneath said center section.

14. A coin sorter in accordance with claim 13 together with a motor connected to rotate said disc and a switch which is actuated by the presence of the collar in a home position with each drawer beneath a sorting station, said switch when actuated, allows the completion of a circuit to energize said motor.

15. A coin sorter in accordance with claim 14 wherein said center section is supported on a standard rising from said base, a bag support plate is disposed between said base and the underside of said center section and at least one of said drawers has an open bottom and means to secure a bag around the drawer.

16. A coin sorter in accordance with claim 15 together with means suspending said plate from said collar, said means providing for the adjustment of the position of said plate relative to said collar to accommodate bags of different sizes.

17. A method of sorting coins from a mixture of coins of different denominations, comprising the steps of:

depositing coins on the surface of a rotating disc;

separating the mixture into a single layer and a single file of coins while moving the coins to an exit position on the disc;

tipping the coins at the exit;

carrying the single file of coins along the peripheral edge of the rotating disc; and sorting the coins by size as they are carried along the peripheral edge of the disc.

18. The method in accordance with claim 17 together with the step of counting the coins just prior to their being sorted away from the edge of the disc.

19. A coin aligning mechanism for mixed sizes of coins, comprising:

a rotatable disc having a resilient surface;

means for rotating said disc; and a stationary plate spaced from said surface of said disc, said plate having a central opening so that coins may be placed on said disc, said plate having a series of guide surfaces opposing said disc and which separate and align the coins into a single file and single layer and direct the file of coins to an exit at the periphery of said plate, said guide surfaces including three recessed areas each eccentric of the axis of rotation of said disc and each spaced from said disc surface a distance greater than the thickness of the thickest coin, said recessed areas being separated from each other by walls which extend toward the disc surface and are spaced therefrom a distance less than the thickness of the thinnest coin, one of said recessed areas being disposed adjacent said central opening and another of said recessed areas terminating in said exit and ramps leading from the outer perimeter of each recessed area to a respective wall so that a single layer of coins will be moved from a recessed area to between a wall and said disc surface and then beyond said wall to the next recessed area.

20. A coin aligning mechanism in accordance with claim 19 wherein a peripheral wall defines the outer edge of the exit recessed area, and the peripheral wall joins at a ramp with the wall which separates the exit recessed area from its adjacent recessed area, said two walls diverging from each other in the direction of rotation of said disc relative to said plate.

21. A coin aligning mechanism for coins of mixed sizes in which the thickness of the thickest coin is a multiple of the thickness of the thinnest coin, comprising:

a rotatable disc having a resilient surface;

means for rotating said disc;

a stationary plate spaced from said surface of said disc, said plate having a central opening so that coins may be placed on said disc, said plate having a series of guide surfaces opposing said disc and which separate and align the coins into a single file and single layer, said guide surfaces including a recessed area having a surface spaced from said disc a distance greater than the thickness of the thickest coin, an arcuate surface bordering said recessed area and being spaced from said disc surface a distance which is less than the thickness of the thinnest coin, and a pair of ramps spaced from each other in the direction of rotation of the disc along said plate, a first of said ramps leading from said recessed area to an intermediate surface which is spaced from said disc surface a distance which is greater than the thickness of the thinnest coin but less than twice such thickness, and the second of said ramps leading from said intermediate surface to said arcuate surface.

22. A coin aligning mechanism in accordance with claim 21 wherein said intermediate surface widens from said first ramp to said second ramp.

23. A coin aligning mechanism in accordance with claim 22 wherein said second ramp has a width which is less than the diameter of the smallest coin.

* * * * *